US005369931A

United States Patent [19]

Emmerson

[11] Patent Number: 5,369,931

[45] Date of Patent: Dec. 6, 1994

[54] LOUVER FRAME, AND METHOD OF INSTALLATION OF A LOUVER IN THE FRAME

[75] Inventor: Terry N. Emmerson, Edmonton, Canada

[73] Assignee: Inner Fit Enterprises, Inc., Edmonton, Canada

[21] Appl. No.: 25,334

[22] Filed: Feb. 25, 1993

[51] Int. Cl.[5] ..... F21V 21/30

[52] U.S. Cl. ..... 52/768; 52/476; 52/506.07; 362/148; 362/150; 362/330; 362/408

[58] Field of Search ..... 52/476, 484, 487, 768, 52/506.07; 248/343; 362/148, 150, 290, 330, 342, 408

[56] References Cited

U.S. PATENT DOCUMENTS

| | | | |
|---|---|---|---|
| 3,021,929 | 2/1962 | Carlin et al. | 52/484 |
| 3,383,811 | 5/1968 | Ades | 52/484 X |
| 3,417,530 | 12/1968 | Long | 52/484 X |
| 4,175,360 | 11/1979 | Mulvey | 52/484 X |
| 4,272,804 | 6/1981 | Blum | 248/343 X |
| 4,619,086 | 10/1986 | Naka | 52/484 X |
| 4,951,443 | 8/1990 | Caferro | 52/484 X |

FOREIGN PATENT DOCUMENTS

| | | | |
|---|---|---|---|
| 571918 | 10/1958 | Belgium | 52/484 |
| 1104351 | 2/1968 | United Kingdom | 52/484 |

OTHER PUBLICATIONS

Product brochure, Retrofit Systems, Kwik Change, dated Jan., 1990, Ontario, Canada, Author: Liteline Corporation, 2 pages.

Product brochure, The Eliminator Framing System, date precedes filing of application, U.S.A., Author: Louvers International, 6 pages.

*Primary Examiner*—Carl D. Friedman
*Assistant Examiner*—Kevin D. Wilkens
*Attorney, Agent, or Firm*—Anthony R. Lambert

[57] ABSTRACT

A frame for a louver holds the louver below the ceiling surface, away from a light fixture. This helps to collimate the light rays and direct the light downward, thus preventing unwanted sideways glare. In addition, the use of a frame tends to hold the louver more securely in the ceiling framework. The frame is formed of Z-shaped members, with one arm of the Z resting on the T-bar cross-bar and the other arm supporting the louver. A stop along one side of the frame prevents movement of the louver in the frame. In one aspect of the invention, rotatable angle supports at the ends of the frame rotate from a vertical position for use during louver installation to a horizontal supporting position for supporting the louver in the frame.

6 Claims, 3 Drawing Sheets

LOUVER FRAME, AND METHOD OF INSTALLATION OF A LOUVER IN THE FRAME

FIELD OF THE INVENTION

This invention relates to frames for holding louvers in a T-bar ceiling, and to a method of installation of a louver in the frame.

BACKGROUND AND SUMMARY OF THE INVENTION

Conventionally, so far as the inventor is aware, a louver is installed directly on T-bar members that often form the framework of ceilings in for example office complexes. The lower side of the louver is therefore typically more or less flush with the ceiling surface, save for the thickness of the cross-bar on the T-bar. Such a louver is not typically very securely held in the ceiling. If it becomes dislodged, it can fall.

The present invention is directed towards providing a frame for a louver that holds the louver below the ceiling surface, away from the light fixture. This helps to collimate the light rays and direct the light downward, thus preventing unwanted sideways glare. In addition, the use of a frame tends to hold the louver more securely in the ceiling framework. The frame is formed of Z-shaped members, with one arm of the Z resting on the T-bar cross-bar and the other arm supporting the louver. A stop along one side of the frame prevents movement of the louver in the frame. In one aspect of the invention, rotatable angle supports at the ends of the frame rotate from a vertical position for use during louver installation to a horizontal supporting position for supporting the louver in the frame.

Further elucidation of the invention appears in the description and claims that follow.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
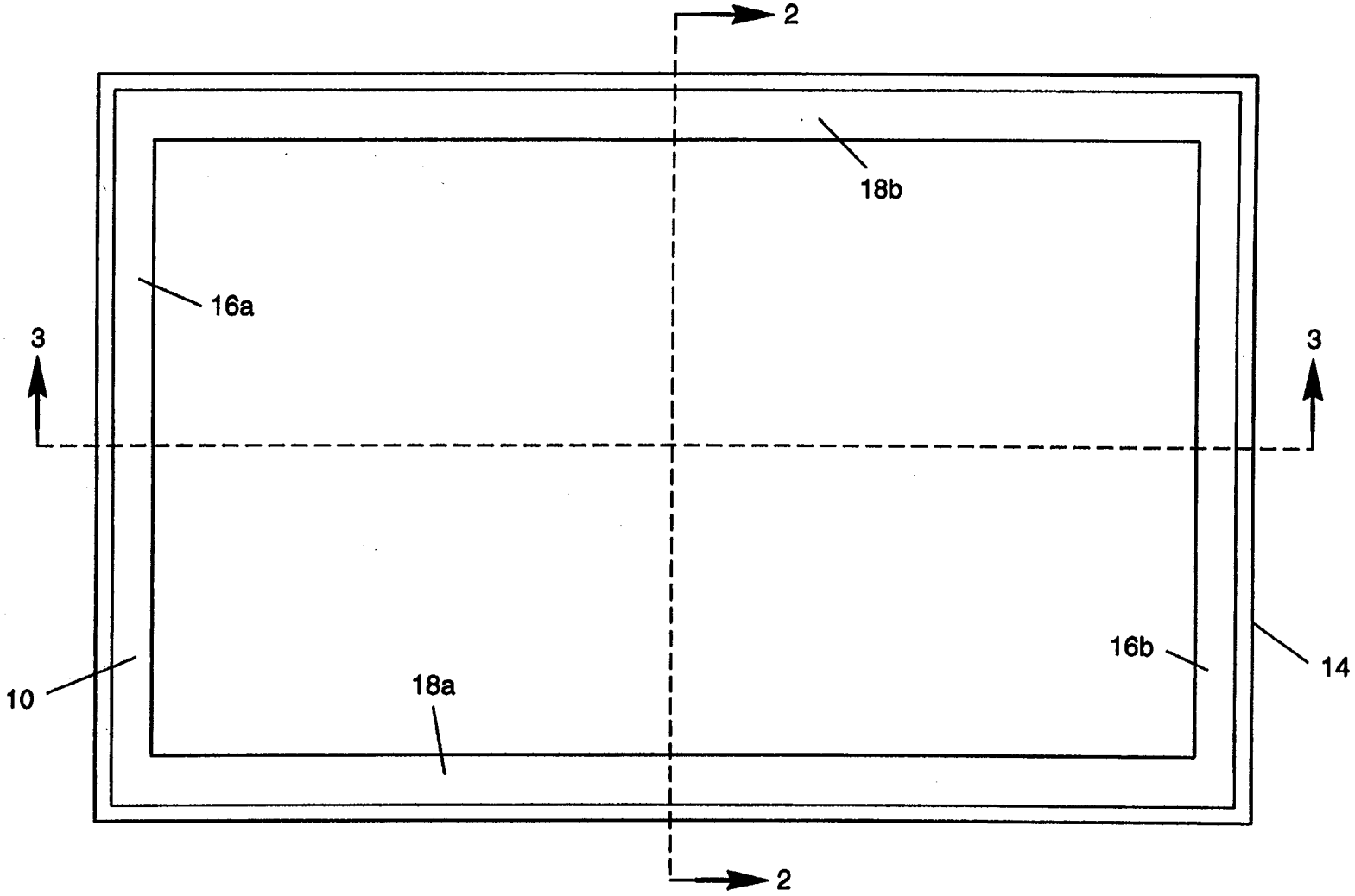
FIG. 1 is a plan view of a louver and frame according to the invention.
Figure 2:
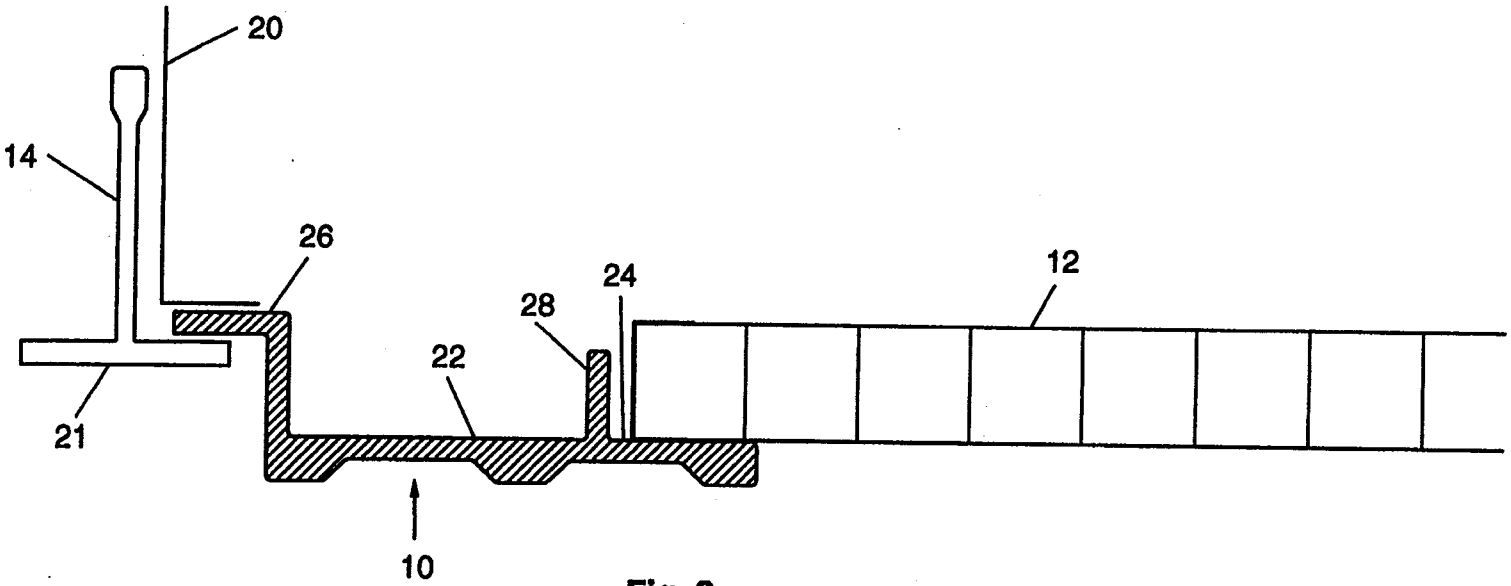
FIG. 2 is a cross-section along the line 2 in FIG. 1.

FIG. 1 shows a rectangular frame 10 installed in a ceiling structure that is formed from conventional T-bar members 14. As shown in FIG. 2 the cross-bars of the T-bar members 14 support the frame, and a light fixture 20 rests in turn on the frame 10 within the T-bar members. A louver 12 rests on and is supported within the frame 10. The lower portions 21 of the T-bar members 14 define a plane, which in the conventional structure would define the plane of the ceiling itself.

The frame 10 is formed of first and second opposed ends 16*a*, 16*b* and first and second opposed sides 18*a*, 18*b*, which together define the perimeter of the frame 10. The ends 16*a*, 16*b* are parallel to each other and together define a plane. Each side 18*a*, 18*b* includes a plate portion 22 having a surface 24 for receiving and supporting the louver 12 and a lip 26 offset from the surface 24. Offset from the surface means out of the plane defined by the surface 24. Along each side 18*a*, 18*b* of the frame 10 mounted on and extending from the supporting surface 22 there is a stop or barrier 28, the separation between the two stops on either side of the frame being such as to allow the louver to fit snugly without being able to slip out from the frame as a result of sideways movement of the louver in the frame.

The dimensions of the frame 10 are selected such that in use the lip 26 overlaps the T-bar members 14 and the surface 24 is out of the plane of the T-bar members 14 in a direction opposite to the light fixture 20 so that, in use, the frame holds the louver below the ceiling surface.

Each end 16*a*, 16*b* includes an inside edge 31 and an angle support 32 having a support portion 34 and an end portion 36 substantially at right angles to each other. The angle support 32 is pivotally connected to the frame 10 for example at the stop 28 for rotation about an axis adjacent the inside edge 31 and substantially parallel to the end 16*a* or 16*b*.

Figure 3:
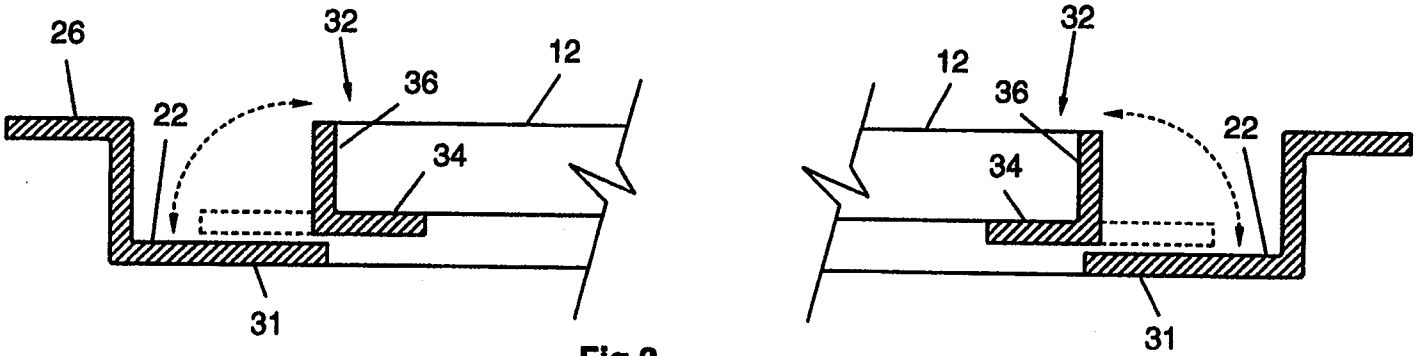
FIG. 3 is a cross-section along the line 3 in FIG. 1.

Each angle support 32 is thus rotatable from a position in which the support portion 34 lies substantially in a plane parallel to the plane defined by the ends 16*a*, 16*b* for supporting the louver 12, as shown in FIG. 3, to a position in which the support portion 34 lies in a plane perpendicular to the plane defined by the ends 16*a*, 16*b* for allowing the louver 12 to be inserted into the frame 10. The installation position of the angle support is shown in dashed lines in FIG. 3. The rotation of the angle support in the downward direction can be limited by suitable stops (not shown) for example on the sides 18*a*, 18*b*. It is preferred that the height of the support portion 34 in its support position be about the height of the support surface 24 so that the louver rests equally on the sides and the angle support.

Figure 5A:
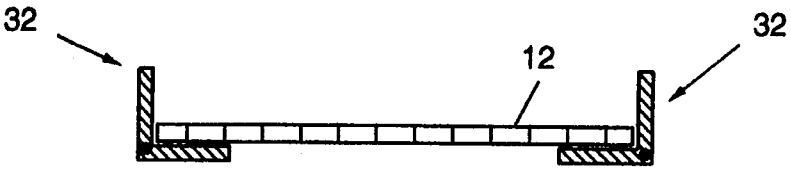
FIGS. 5*a*, 5*b* and 5*c* are a series of schematics showing the removal of a louver from a frame according to the invention.
Figure 4A:
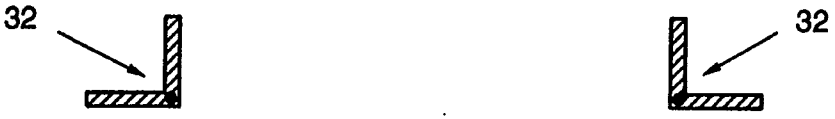
FIGS. 4*a*, 4*b*, 4*c* and 4*d* are a series of schematics showing the installation of a louver in a frame according to the invention.

The installation and removal of a louver 12 in a frame 10 is illustrated in FIGS. 4*a*, *b*, *c* and *d*, and FIGS. 5*a*, *b* and *c*.

Figure 4B:
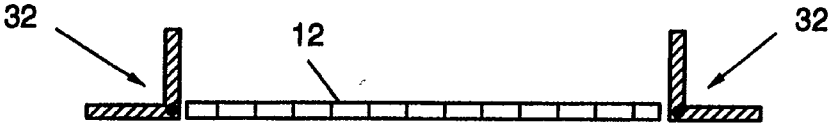
Figure 4C:
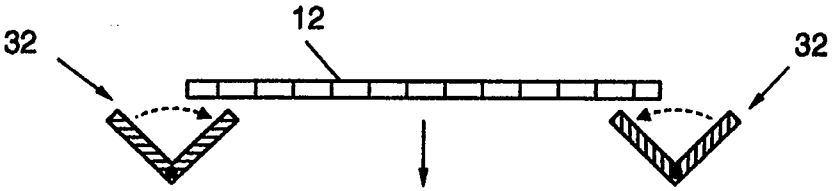
Figure 4D:
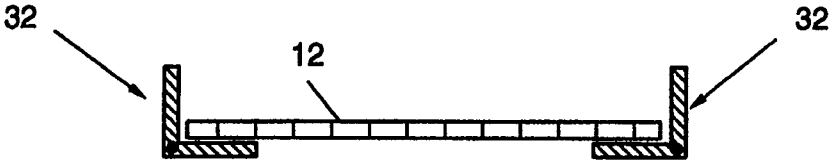

Firstly, the frame 10 is, or may be taken to be, installed in the ceiling structure with the frame resting on the T-bar members 14. At this point, the frame is empty and defines an interior space 38 separating the ends 16*a* and 16*b* and the sides 18*a* and 18*b*. The angle supports 32 are rotated away from the interior space to the position in which the support portions are vertical as shown in FIG. 4*a*. The louver 12 is then inserted into the frame 10 through the interior space as shown in FIG. 4*b* and sufficiently above the angle supports 32 to allow them to rotate freely. The louver may have to be rotated to allow it to slip between the sides 18*a* and 18*b*. The angle supports 32 are then rotated towards the interior space with the support portions of the angle supports overhanging the interior space as shown in FIG. 4*c*, and the louver is lowered until it rests on the support portions 34 of the angle supports as shown in FIG. 4*d*.

Figure 5B:
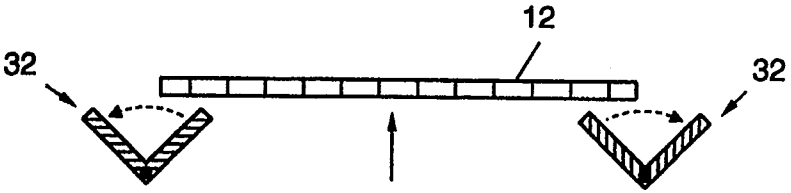
Figure 5C:
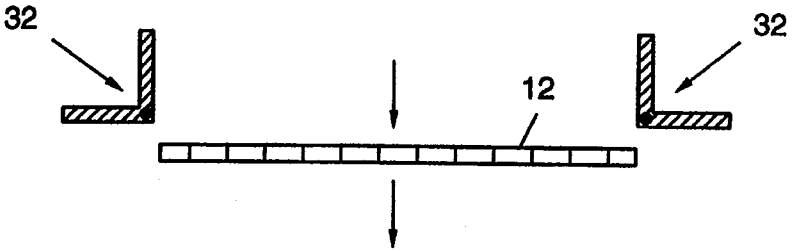

Removal is the reverse of installation. The louver 12 is raised upward out of the angle supports 32 as shown in FIG. 5*a*. The angle supports 32 are rotated out of the way as shown in FIG. 5*b*, and then the louver 12 may be lowered out of the frame through the interior space as shown in FIG. 5*c*, with rotation about an axis parallel to the sides 18*a*, 18*b* if necessary to clear the sides 18*a* and 18*b*.

The preferred offset of the surface 24 from the lip 26 is ½", but other offsets may be used, such as ¾".

The frame and angle support are preferably made from extruded aluminum. The louver itself is conventional.

A person skilled in the art could make immaterial modifications to the invention described and claimed in this patent without departing from the essence of the invention.

The embodiments of the invention in which an exclusive property or privilege is claimed are defined as follows:

1. A rectangular frame for supporting a louver in a ceiling structure having spaced T-bar members, the frame comprising:

first and second opposed ends and first and second opposed sides together defining a perimeter of the frame;

the first side including a first lip, a first support leg depending from the first lip and a supporting surface offset from the first lip and extending from the first support leg in an inward direction opposed to the first lip;

the second side including a second lip, a second support leg depending from the second lip and a second supporting surface offset from the second lip and extending from the second support leg in an inward direction opposed to the second lip;

the first lip spaced from the second lip complementarily to the spacing of the T-bar members; and first and second stops mounted on the first and second supporting surfaces respectively inward of the first and second supporting legs.

2. The rectangular frame of claim 1 in combination with a T-bar system and light fixture.

3. A rectangular frame for supporting a louver in a ceiling structure having spaced T-bar members, the frame comprising:

first and second opposed ends and first and second opposed sides together defining a perimeter of the frame;

each end including an inside edge and an angle support having a support portion and an end portion substantially at right angles to each other, the angle support being pivotally connected to the frame for rotation about an axis adjacent the inside edge and substantially parallel to the end, the first end and the second end defining a first plane; and each angle support being rotatable from a position in which the support portion lies substantially in a second plane parallel to the first plane, to a position in which the support portion lies in a third plane perpendicular to the first plane.

4. The rectangular frame of claim 3 in which:

the first side includes a first lip, a first support leg depending from the first lip and a supporting surface offset from the first lip and extending from the first support leg in an inward direction opposed to the first lip;

the second side includes a second lip, a second support leg depending from the second lip and a second supporting surface offset from the second lip and extending from the second support leg in an inward direction opposed to the first lip;

the first lip is spaced from the second lip complementarily to the spacing of the T-bars members; and first and second stops are mounted on the first and second supporting surfaces respectively inward of the first and second supporting legs.

5. The rectangular frame of claim 3 in combination with a T-bar system and light fixture.

6. A method of mounting a louver in a ceiling structure having T-bar members using a frame having rotatable angle supports at opposed ends of the frame, the frame defining an interior space, the rotatable angle supports being rotatable from a position in which a support portion overhangs the interior space to a position in which the support portion is away from the interior space, the method comprising the steps of:

installing the frame in the ceiling structure with the frame resting on the T-bar members;

rotating the angle supports away from the interior space;

inserting the louver in the frame through the interior space;

rotating the angle supports towards the interior space with the support portions of the angle supports overhanging the interior space; and resting the louver on the support portions of the angle supports.

* * * * *